US010137967B2

(12) United States Patent
Smith

(10) Patent No.: US 10,137,967 B2
(45) Date of Patent: Nov. 27, 2018

(54) WINDLASS ASSEMBLY

(71) Applicant: Lewmar Limited, Hampshire (GB)

(72) Inventor: Nigel Christopher Smith, Warsash (GB)

(73) Assignee: LEWMAR LIMITED, Hampshire (GB)

( * ) Notice: Subject to any disclaimer, the term of this patent is extended or adjusted under 35 U.S.C. 154(b) by 415 days.

(21) Appl. No.: 14/939,739

(22) Filed: Nov. 12, 2015

(65) Prior Publication Data

US 2016/0137266 A1 May 19, 2016

(30) Foreign Application Priority Data

Nov. 17, 2014 (GB) ..... 1420391.3

(51) Int. Cl.
*B66D 1/70* (2006.01)
*B63B 21/22* (2006.01)
*B66D 1/72* (2006.01)

(52) U.S. Cl.
CPC ..... *B63B 21/22* (2013.01); *B63B 21/227* (2013.01); *B66D 1/72* (2013.01)

(58) Field of Classification Search
CPC ..... B63B 21/22; B63B 21/227; B66D 1/72
See application file for complete search history.

(56) References Cited

U.S. PATENT DOCUMENTS 284,979 A 9/1883 Purdy
2,506,893 A * 5/1950 Rogers ..... B63B 21/22 114/210
2,564,801 A 8/1951 Cook
2,669,427 A * 2/1954 Dowrelio ..... B66D 1/72 114/210
2,734,475 A * 2/1956 Fyock ..... B63B 21/22 114/210
3,147,731 A 9/1964 Stuart, Sr.
3,577,951 A * 5/1971 Smith ..... B63B 21/22 114/210
3,834,670 A 9/1974 Pityo
3,934,536 A * 1/1976 Galamore ..... B63B 21/22 114/210
4,057,025 A * 11/1977 Piotrowski ..... B63B 21/22 114/210
4,070,981 A 1/1978 Guinn et al.
4,148,465 A * 4/1979 Bowman ..... B66D 1/28 114/210

(Continued)

FOREIGN PATENT DOCUMENTS

GB 274 029 9/1927

OTHER PUBLICATIONS

"Pro-Series Windlass." Lewmar. N.p., n.d. Web. Nov. 15, 2014. <http://www.lewmar.com/node/11626>.

*Primary Examiner* — Emmanuel M Marcelo
(74) *Attorney, Agent, or Firm* — Leason Ellis LLP

(57) ABSTRACT

A windlass assembly for a marine craft anchoring system is disclosed. The assembly comprises, before attachment to the craft, a windlass portion and a bow roller portion connected to each other via a connection portion. The connection portion provides a mechanical link between the windlass portion and the bow roller portion, secures alignment between the windlass portion and the bow roller portion and fixes the spacing between the windlass portion and the bow roller portion.

12 Claims, 12 Drawing Sheets

(56) References Cited

U.S. PATENT DOCUMENTS

| | | | | | |
|---|---|---|---|---|---|
| 4,242,977 | A * | 1/1981 | Long | B63B 21/22 | 114/210 |
| 4,526,123 | A * | 7/1985 | van den Haak | B63B 21/22 | 114/210 |
| 4,556,007 | A * | 12/1985 | Awalt, Jr. | B63B 21/22 | 114/210 |
| 4,616,589 | A * | 10/1986 | Adams | B63B 21/22 | 114/210 |
| 4,913,076 | A * | 4/1990 | Norton | B63B 21/22 | 114/210 |
| 5,803,008 | A * | 9/1998 | Georgens | B63B 21/04 | 114/293 |
| 5,996,524 | A * | 12/1999 | Johnson | B63B 21/22 | 114/210 |
| 6,712,338 | B2 | 3/2004 | Schafer | | |
| 2005/0160961 | A1* | 7/2005 | Francis | B63B 15/00 | 114/343 |
| 2010/0319601 | A1* | 12/2010 | Walderhaug | B63B 21/22 | 114/343 |
| 2013/0014684 | A1* | 1/2013 | Heying | B63B 21/22 | 114/210 |
| 2013/0187105 | A1* | 7/2013 | Xydias | B66D 1/30 | 254/277 |
| 2015/0166146 | A1* | 6/2015 | Kutsen | B63B 21/22 | 114/210 |

* cited by examiner

WINDLASS ASSEMBLY

CROSS-REFERENCE TO RELATED APPLICATIONS

The present application claims priority under 35 U.S.C. § 119 to British Patent Application No. 1420391.3, filed Nov. 17, 2014, which is hereby incorporated by reference in its entirety.

BACKGROUND TO THE INVENTION

Field of the Invention

The present invention relates to a windlass assembly and to a method of installation of a windlass assembly and to a method of manufacture of a windlass assembly. It is of particular interest in relation to marine craft such as sailboats or powerboats typically used for leisure.

Related Art

A form of windlass having a gypsy (in which a line and/or chain executes only a single turn between inward and outward runs) is commonly used on marine craft to haul and let out the anchor rode i.e. the line and/or chain. Since the combined weight of the anchor and chain can be relatively great, windlasses powered by electric or hydraulic motors are known. These typically haul the chain over the gypsy of the windlass and allow the anchor rode to fall under gravity into an anchor locker under the deck of the craft at the bow. One example of such a windlass is the Lewmar Pro-Series windlass, Part Number: 6657011198-311 (http://www.lewmar.com/products.asp?id=8329&lid=25799 accessed 15 Nov. 2014).

The anchor rode is typically guided over the bow of the craft by a bow roller. The bow roller may provide a fairlead to ensure that the anchor rode does not escape from the bow roller during hauling and letting out of the anchor.

In view of the need to provide a suitable space for the anchor locker, the windlass is usually set back a particular distance (which may vary from craft to craft) from the bow of the craft, so that the windlass can be located directly above the anchor locker.

The installation of the windlass and the bow roller may be carried out by the boat manufacturer at different stages of the manufacture of the vessel. In view of the critical requirements for safe anchoring, the windlass and the bow roller are typically secured to be craft using a substantial number of fixings (e.g. bolts or screws). The installation of these items can represent a substantial and labour-intensive aspect of the boat-building process.

SUMMARY OF THE INVENTION

The present inventors have realised that the installation of the windlass and the bow roller separately, although conventional in boat building at the time of writing, is capable of improvement, for example to reduce installation time, complexity and to simplify alignment issues between the bow roller and the windlass.

The present invention has been devised in order to address at least one of the above problems. Preferably, the present invention reduces, ameliorates, avoids or overcomes at least one of the above problems.

Accordingly, in a first preferred aspect, the present invention provides a windlass assembly for a marine craft anchoring system, the assembly comprising, before attachment to the craft, a windlass portion and a bow roller portion connected to each other via a connection portion, the connection portion being capable of providing a mechanical link between the windlass portion and the bow roller portion, capable of securing alignment between the windlass portion and the bow roller portion and capable of fixing the spacing between the windlass portion and the bow roller portion.

In a second preferred aspect, the present invention provides a method of installing a windlass assembly according to the first aspect on a marine craft, the method including the steps of providing a windlass assembly according to the first aspect, and securing the assembly at the bow of the craft, wherein the connection portion provides at least one of:

(i) a mechanical link between the windlass portion and the bow roller portion;

(ii) alignment between the windlass portion and the bow roller portion; and (iii) fixes the spacing between the windlass portion and the bow roller portion, before the assembly is secured to the craft.

Preferably, at least two of (i), (ii) and (iii) are provided before the assembly is secured to the craft. Still more preferably, all of (i), (ii) and (iii) are provided before the assembly is secured to the craft.

In a third preferred aspect, the present invention provides a method of manufacturing a windlass assembly according to the first aspect, the method including, before the assembly is secured to a craft, selecting a connection portion of a desired length from a plurality of connection portions of different lengths, the length being selected to establish a required distance between the windlass portion and bow roller portion, and securing the connection portion between the windlass portion and the bow roller portion.

A windlass and bow roller may therefore be provided together in an integral assembly. As discussed below, in some embodiments the spacing between the windlass portion and the bow roller portion may be fixed. In other embodiments, the spacing between the windlass portion and the bow roller portion may be fixable after adjustment.

The first, second and/or third aspect of the invention may have any one or, to the extent that they are compatible, any combination of the following optional features.

The assembly may include a fairlead portion. The fairlead portion is preferably located at the bow roller portion, to guide the anchor rode with respect to a bow roller.

There may be provided a second roller, aft of the bow roller. The term "aft" is used in terms of the intended orientation of the assembly on a craft, with the bow roller being forward of the windlass portion, the windlass portion therefore being aft of the bow roller. The second roller is preferably closer to the bow roller than the windlass portion. The second roller serves to support the anchor rode during hauling and letting out and may also serve to support at least a part of an anchor when the anchor is fully hauled in. In this case, the anchor may also be supported on the bow roller. The limit of travel of the anchor towards the windlass portion may be defined by the anchor coming into contact with the fairlead.

The connection portion preferably defines a channel for the anchor rode to extend between the windlass portion and the bow roller portion. The connection portion preferably has side walls which, when the assembly is installed on a craft, preferably meet the deck of the craft. Each side wall may have an inwardly-extending projection. The effect of this is preferably at least partially to cover the channel. The side walls provide an additional safety feature, which is to prevent inadvertent contact between a person on board with the anchor rode moving in the channel. As will be appreciated, where the windlass and bow roller are provided as separate entities, the anchor rode extends over open deck between them. A fast-moving anchor rode therefore presents a potential safety hazard.

There may be provided a cover on the connection portion. The cover may extend partially or wholly along the length of the connection portion. This cover provides an additional safety feature, to prevent inadvertent contact between a person on board with the anchor rode moving in the channel. In some embodiments, it is preferred for the cover not to extend wholly along the length of the connection portion, in order that the movement of the anchor rode in the channel is clearly visible. Furthermore, there may be a preferred limit on the length of the cover in view of the intended anchor shape to be used with the windlass assembly.

The connection portion has a height which may vary between the windlass portion and the bow roller portion. Preferably, the height of the connection portion immediately adjacent the windlass portion is substantially the same as the height of the windlass portion where it meets the connection portion. Similarly, preferably the height of the connection portion immediately adjacent the bow roller portion is substantially the same as the height of the bow roller portion where it meets the connection portion. In this way, the connection portion preferably provides a smooth, gradual and/or straight transition between any height difference between the windlass portion and the bow roller portion. Typically, the windlass portion has a greater height than the bow roller portion. Preferably, therefore, the height of the connection portion preferably decreases from the windlass portion to the bow roller portion. In this way, the assembly preferably provides a relatively low-profile arrangement, which is easy for a person to step over with minimal risk of tripping.

In some embodiments, the windlass portion, connection portion and bow roller portion may be positionally fixed with respect to each other at the time of manufacture of the assembly. To allow some adaptability of the assembly for varying craft designs, it is preferable in other embodiments for the distance between the windlass portion and the bow roller portion to be adjustable. This may be achieved, for example, by making available a plurality of connection portions of different lengths, a particular length being selected to establish a preferred distance between the windlass portion and bow roller portion. Additionally or alternatively, the connection portion may include a length adjustment mechanism. The length adjustment mechanism may provide discrete steps of adjustability, or the length may be continuously adjustable. Where a cover is provided, the cover may cover at least part of the length adjustment mechanism.

The assembly may further include a rode securing mechanism. It is preferred not to rely on the windlass itself for securing the anchor rode when at anchor and/or when the anchor is fully hauled in (i.e. when the craft is underway or deliberately drifting (as is sometimes wanted for fishing)). The rode securing mechanism may be a chain securing mechanism. Such mechanisms are known, for interacting with one or more links of the chain to prevent unwanted movement of the chain. A suitable chain securing mechanism is a chain stopper. Such a mechanism includes a hinged member with a slot adapted to fit over a link of the chain. The mechanism also preferably includes a stop to limit the travel of the hinged member. The hinged member therefore cooperates with the chain to prevent its movement in a particular direction. The hinged member may be moveable into and out of engagement with the chain via a lever. Typically, the chain stopper is oriented to allow prevention of unwanted letting out of the anchor rode. The chain securing mechanism may alternatively be a devil's claw arrangement. Such an arrangement includes a hook member adapted to fit into or around a link of the chain, the hook member being securable to the craft, e.g. via its own chain.

The rode securing mechanism may be located at the windlass portion, the connection portion or at the bow roller portion. Most conveniently, it is located at the windlass portion, preferably immediately adjacent the connection portion.

The present inventors consider that the inclusion of a rode securing mechanism further enhances the safety aspects of the windlass arrangement of the present invention. The rode securing mechanism can prevent unwanted letting out of the anchor rode when the craft is at anchor. Additionally, it can prevent the anchor coming loose when the craft is under way, thereby preventing the serious damage to the deck and hull than can otherwise be caused by the anchor.

Further optional features of the invention are set out below.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS, AND FURTHER OPTIONAL FEATURES OF THE INVENTION

FIGS. 1 to 6 show a windlass assembly according to an embodiment of the invention in various orientations. FIGS. 7-12 show the windlass assembly of FIGS. 1-6 with an anchor held in the assembly. The same reference numbers are used for the same features in the different drawings, and some reference numbers are omitted from various drawings where they are used and explained elsewhere.

Figure 1:
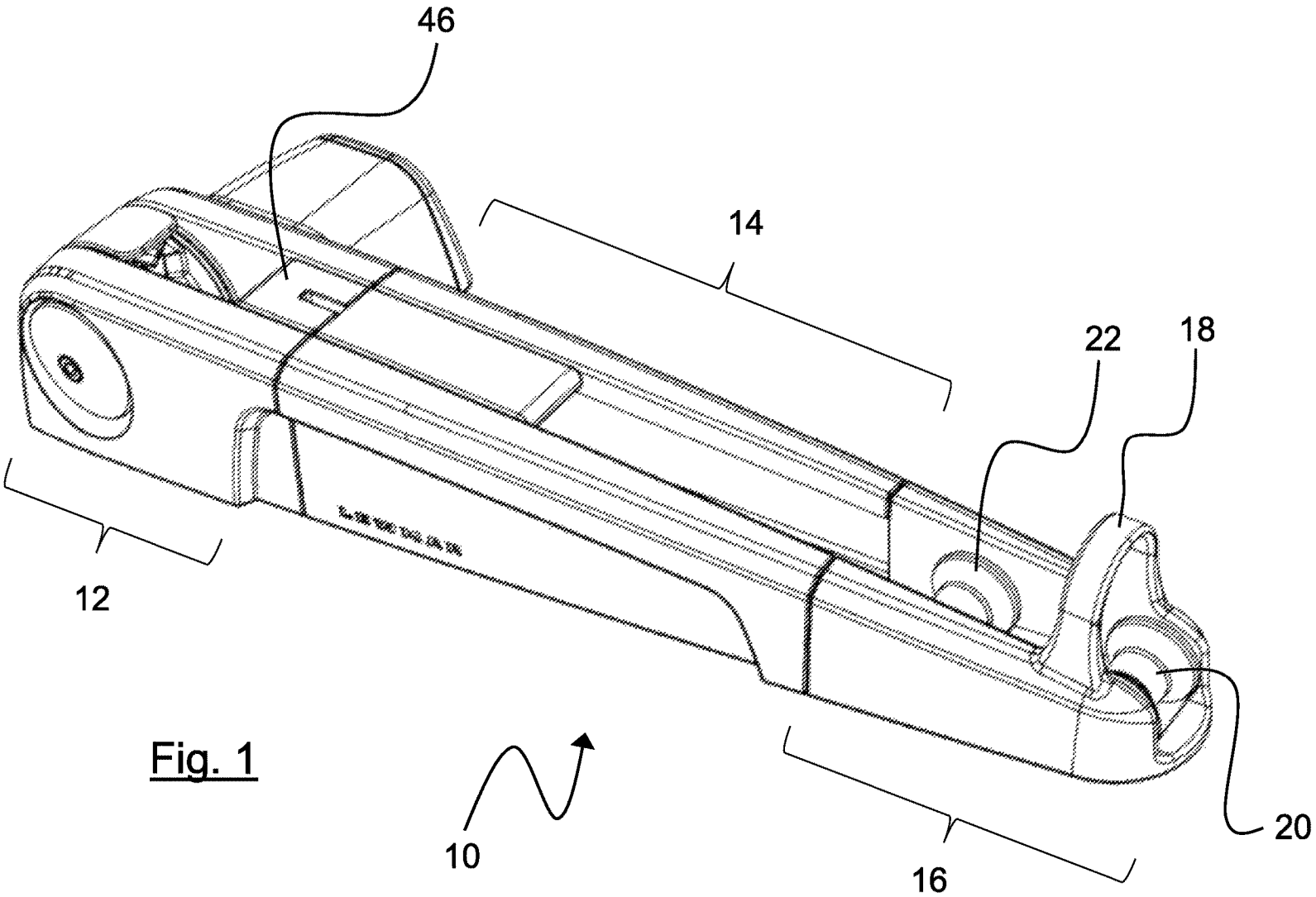
FIGS. 1 to 6 show a windlass assembly according to an embodiment of the invention in various orientations.
Figure 2:
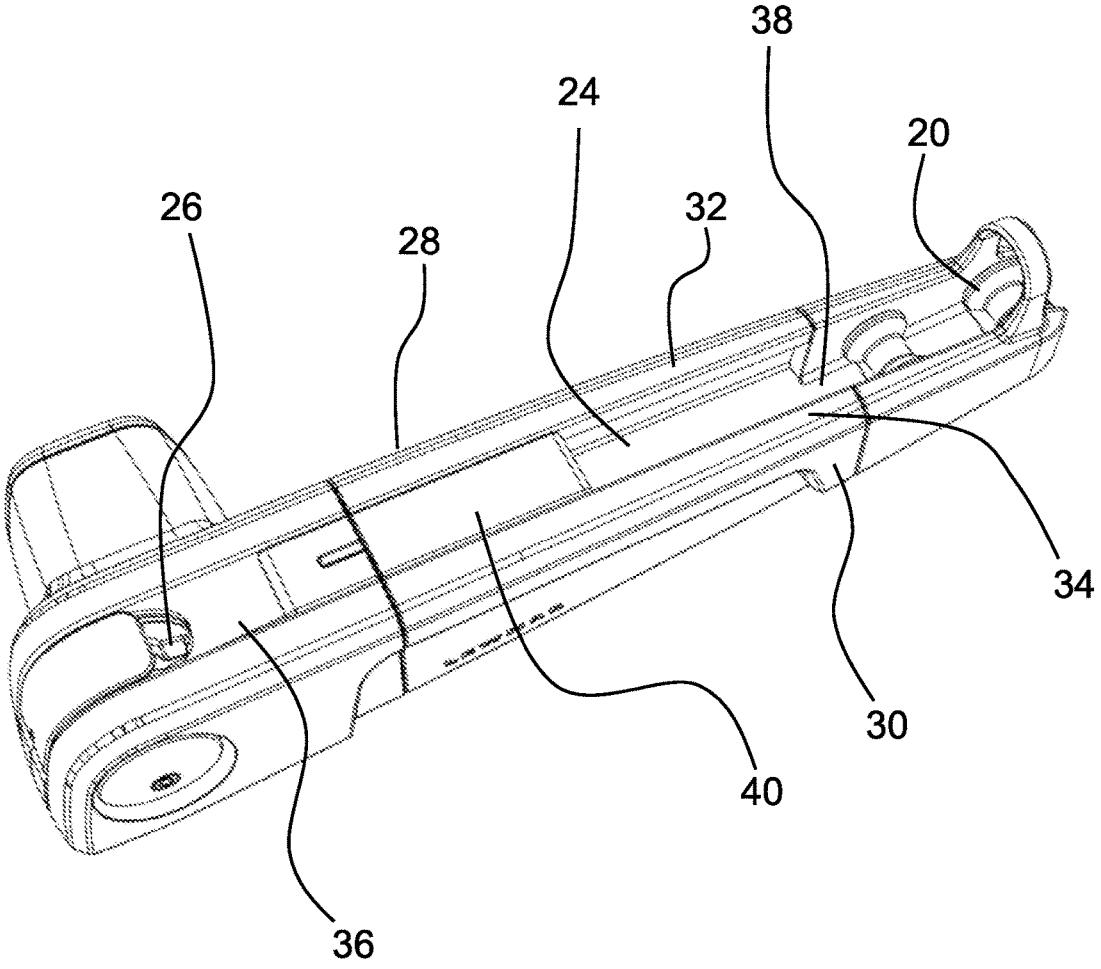
Figure 3:
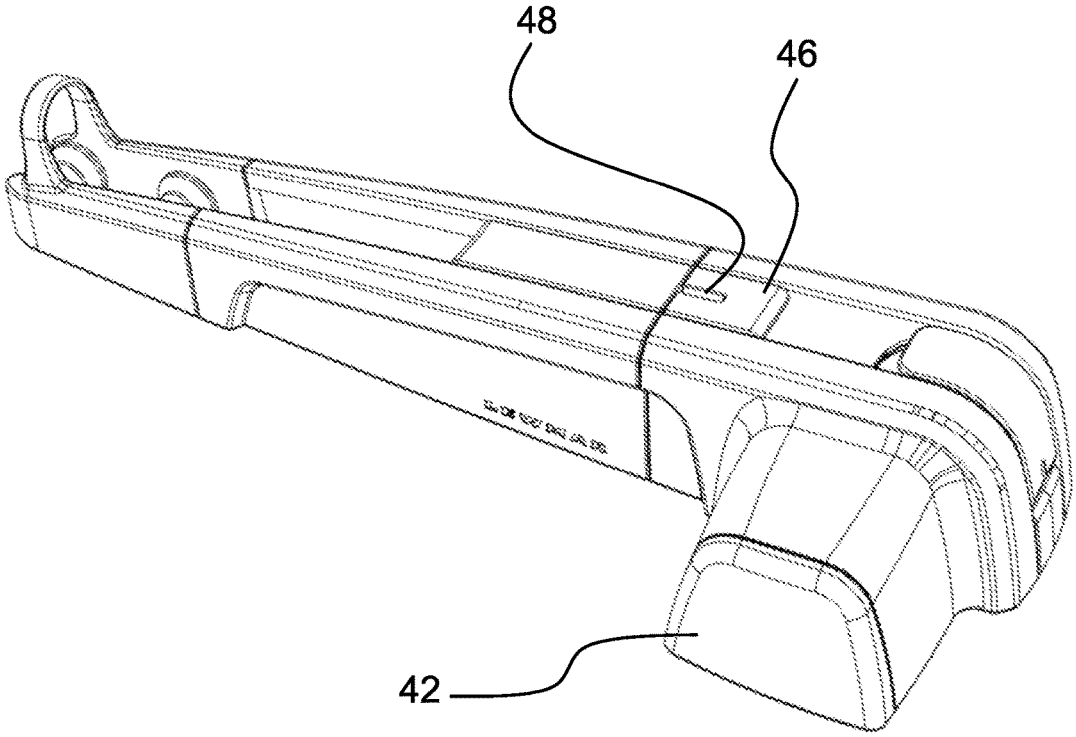
Figure 4:
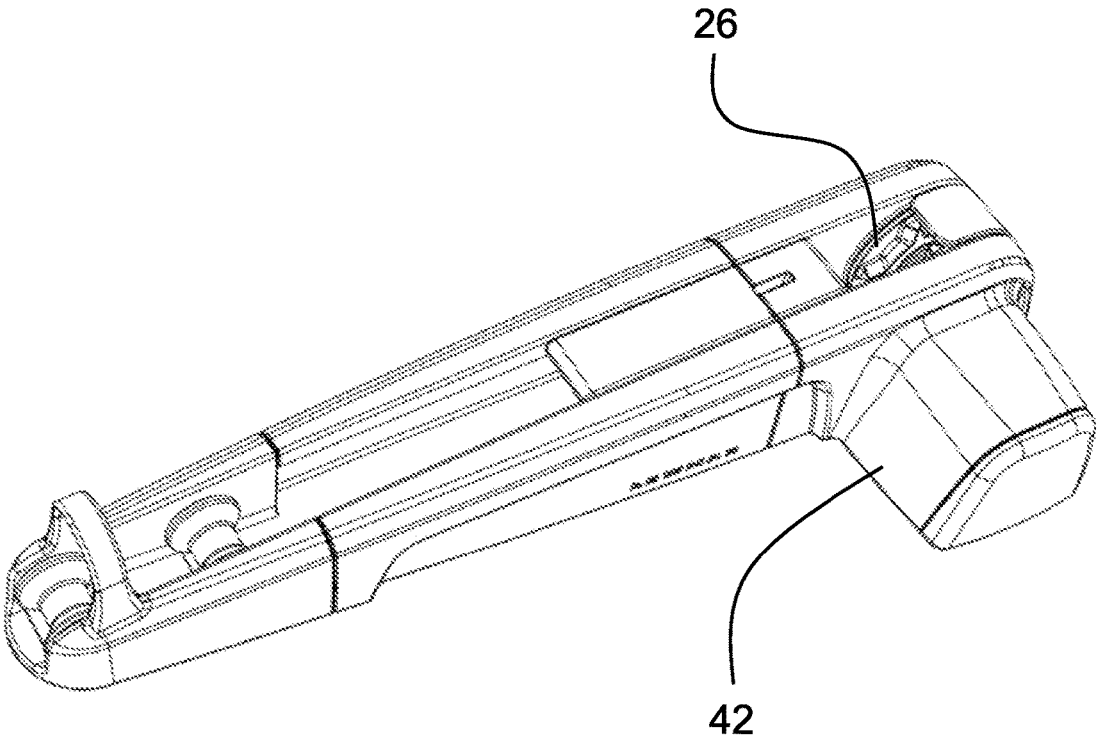

FIG. 1 shows a windlass assembly 10 for a marine craft anchoring system, before installation on a marine craft such as a sailboat or powerboat.

The windlass assembly comprises a windlass portion 12 and a bow roller portion 16 connected to each other via a connection portion 14. The connection portion provides a mechanical link between the windlass portion and the bow roller portion. The connection portion secures alignment between, and fixes the spacing between, the windlass portion and the bow roller portion, even before the assembly is secured to the craft.

In one embodiment, the windlass assembly can be manufactured by, before the assembly is secured to a craft, selecting a connection portion 14 of a desired length from a plurality of connection portions of different lengths, the length being selected to establish a required distance between the windlass portion 12 and bow roller portion 16, and securing the connection portion between the windlass portion 12 and the bow roller portion 16.

In another embodiment, the windlass portion, connection portion and bow roller portion may be formed integrally.

In still another embodiment, discussed below, the spacing between the windlass portion and the bow roller portion may be fixable after adjustment, e.g. adjustment of the connection portion.

The assembly may include a fairlead portion 18, located at the bow roller portion 16. The fairlead portion 18 is formed as a rigid hoop, to guide the anchor rode (not shown) with respect to the bow roller 20.

A second roller 22 is provided, aft of the bow roller 20. The term "aft" is used in terms of the intended orientation of the assembly on a craft, with the bow roller 20 being forward of the windlass portion 12. The second roller 22 is closer to the bow roller 20 than the windlass portion 12. The second roller serves to support the anchor rode during hauling and letting out and also serves to support at least a part of anchor 100 when the anchor is fully hauled in. In this case, the anchor is also be supported on the bow roller 20. The limit of travel of the anchor towards the windlass is defined by the anchor coming into contact with the fairlead 18.

The connection portion 14 defines a channel 24 for the anchor rode to extend between the windlass gypsy 26 and the bow roller 20. The connection portion has side walls 28, 30 which, when the assembly is installed on a craft, meet the deck of the craft. Each side wall has an inwardly-extending projection 32, 34. The effect of this is partially to cover the channel 24. The side walls provide an additional safety feature, which is to prevent inadvertent contact between a person on board with the anchor rode moving in the channel. As will be appreciated, where the windlass and bow roller are provided as separate entities, the anchor rode extends over open deck between them. A fast-moving anchor rode therefore presents a potential safety hazard.

The lateral extent of the channel 24 in the connection portion 12 preferably matches the lateral extent of a corresponding channel 36 in the windlass portion and the lateral extent of a corresponding channel 38 in the bow roller portion 16.

A cover 40 is provided on the connection portion 14. The cover 40 extends partially along the length of the connection portion, leaving part of channel 24 uncovered in order that the movement of the anchor rode in the channel is clearly visible and to accommodate the shape of the anchor to be used with the windlass assembly. The cover provides an additional safety feature, to prevent inadvertent contact between a person on board with the anchor rode moving in the channel.

The windlass portion 12 includes gypsy 26 which is rotatable by a motor located in housing 42, in a known manner. The anchor rode passes around the gypsy for one turn and drops into an anchor locker below deck (not shown).

Figure 5:
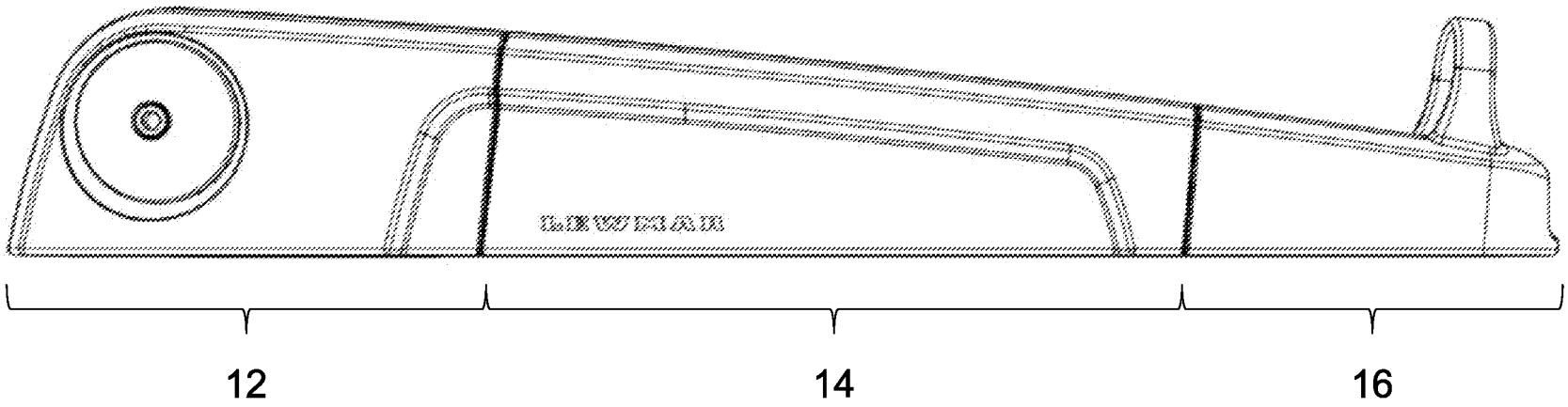
Figure 6:
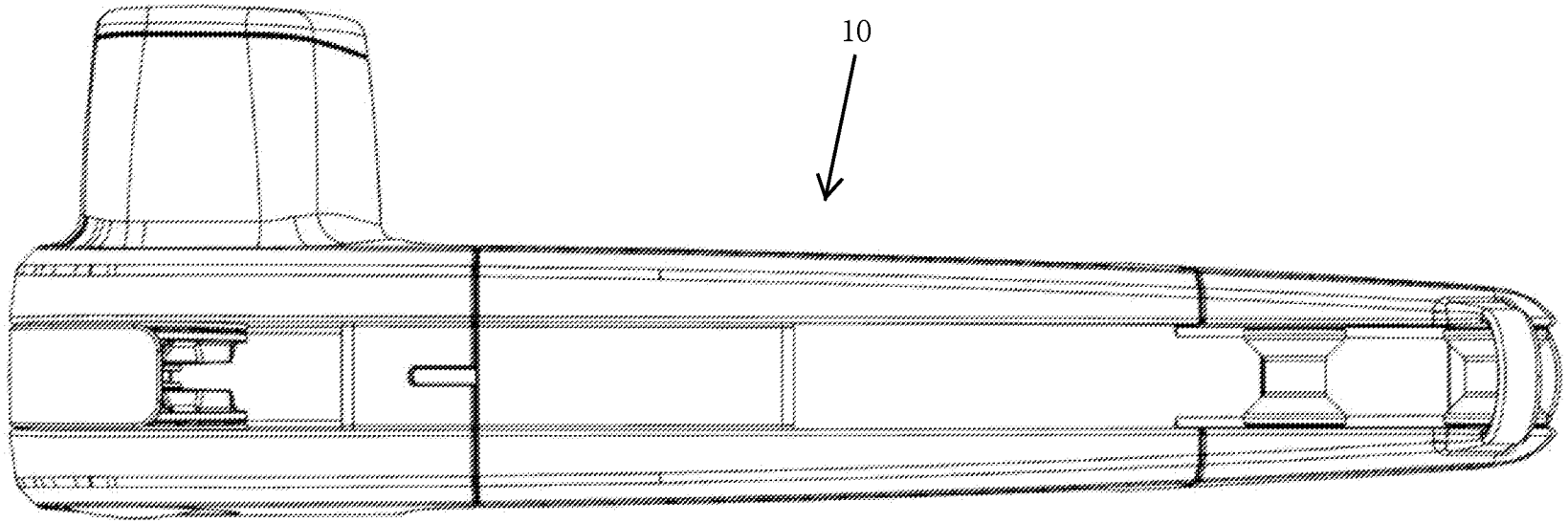
Figure 7:
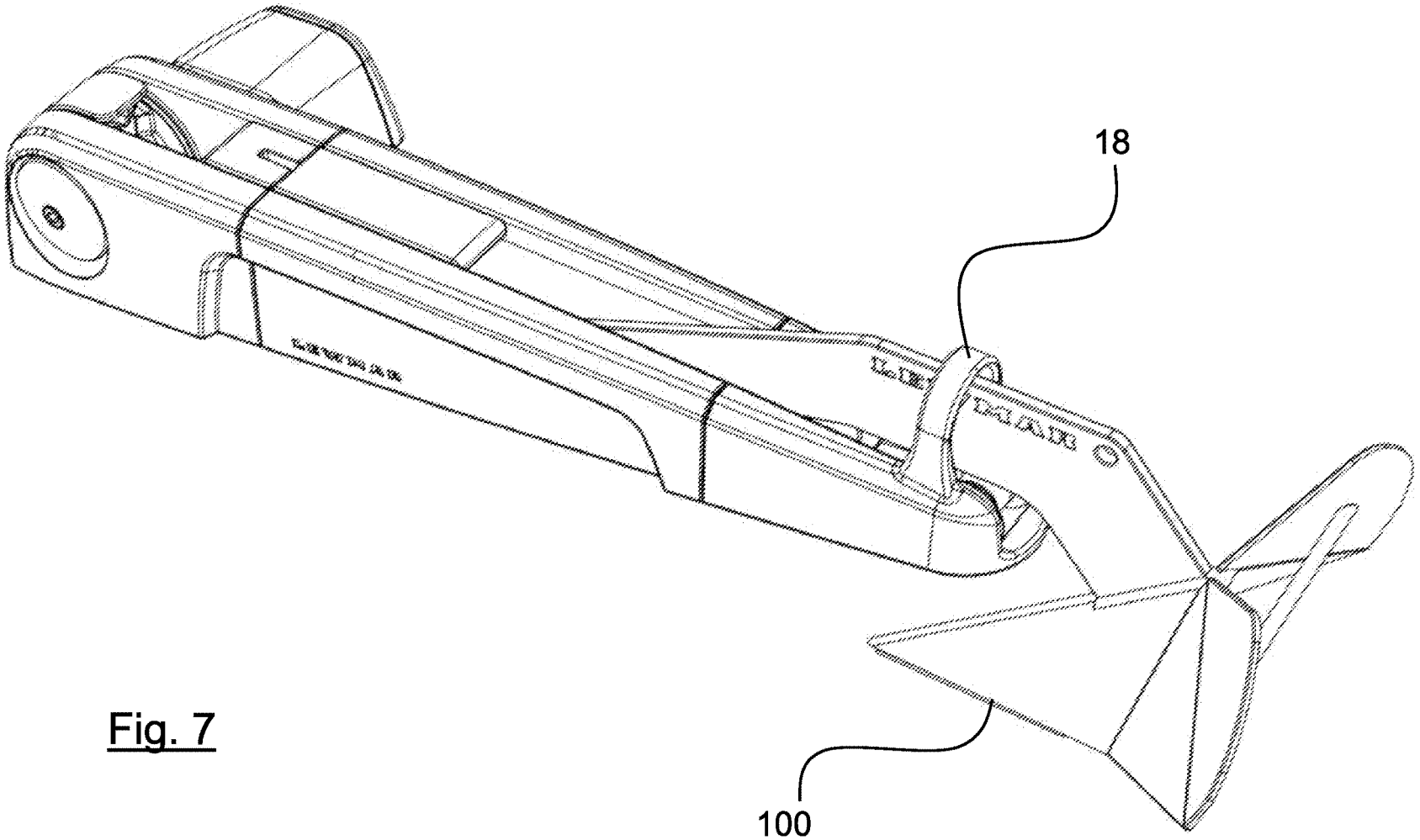
FIGS. 7-12 show the windlass assembly of FIGS. 1-6 with an anchor held in the assembly.
Figure 8:
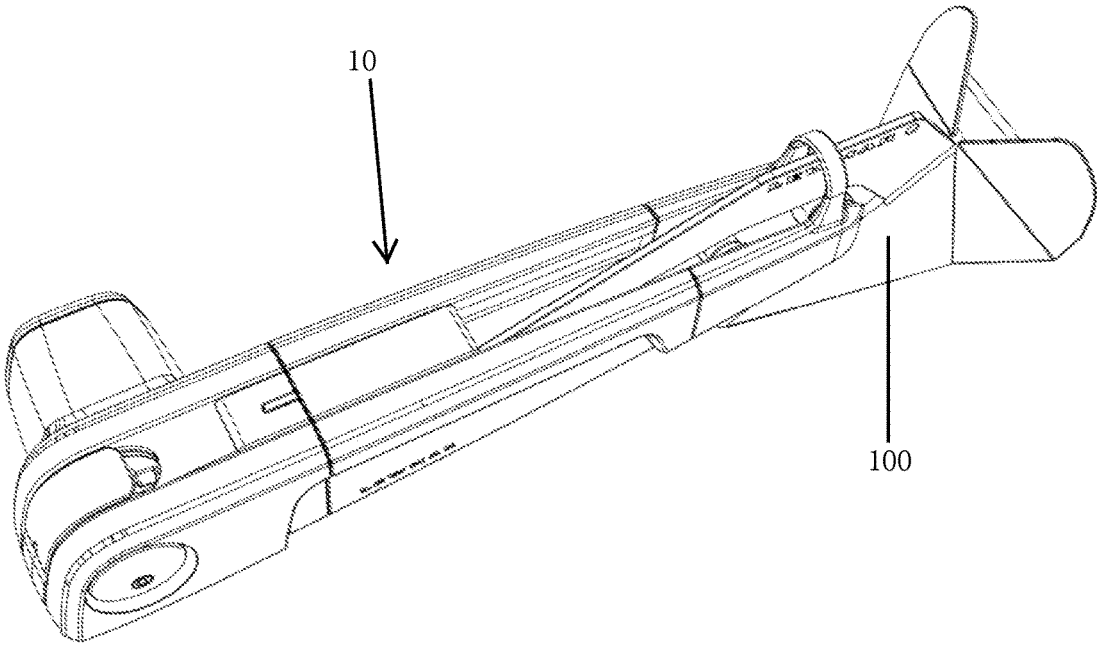
Figure 9:
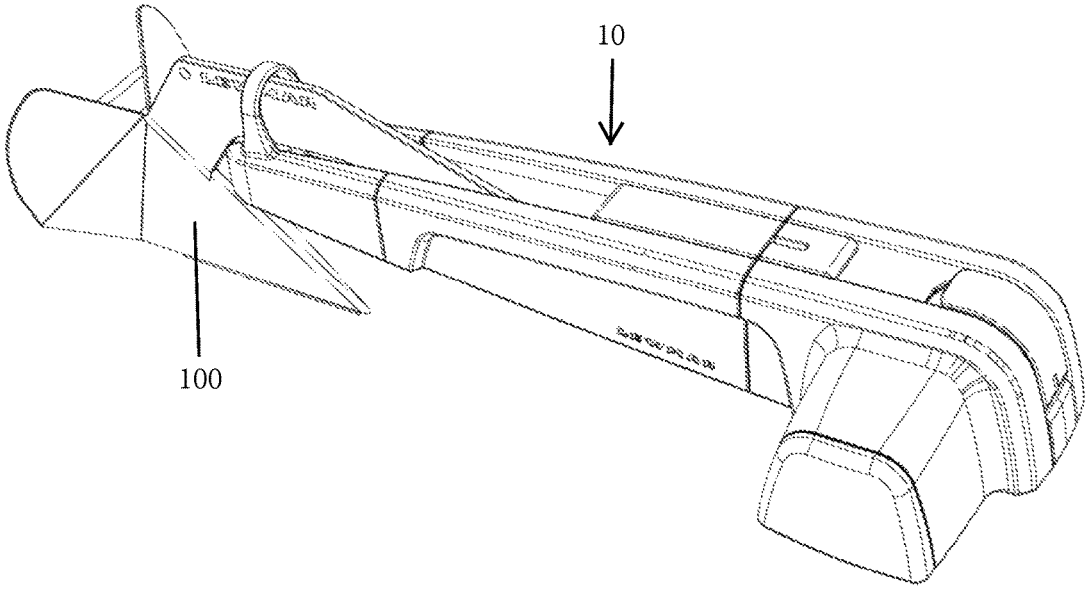
Figure 10:
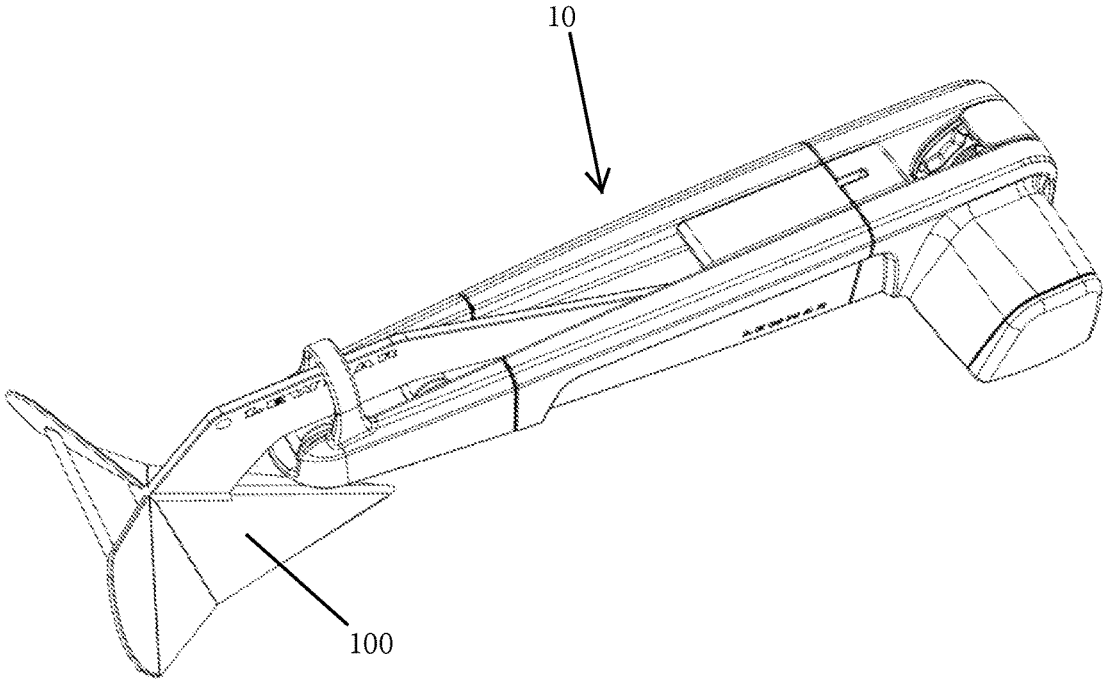
Figure 11:
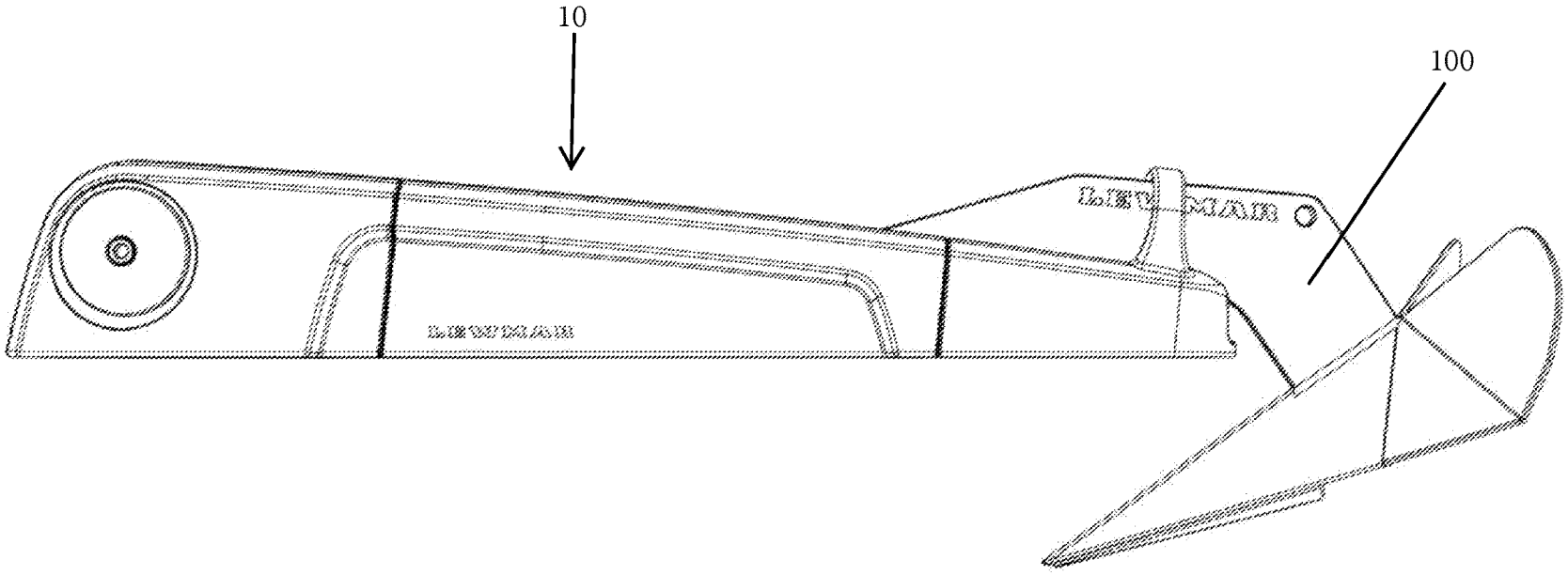
Figure 12:
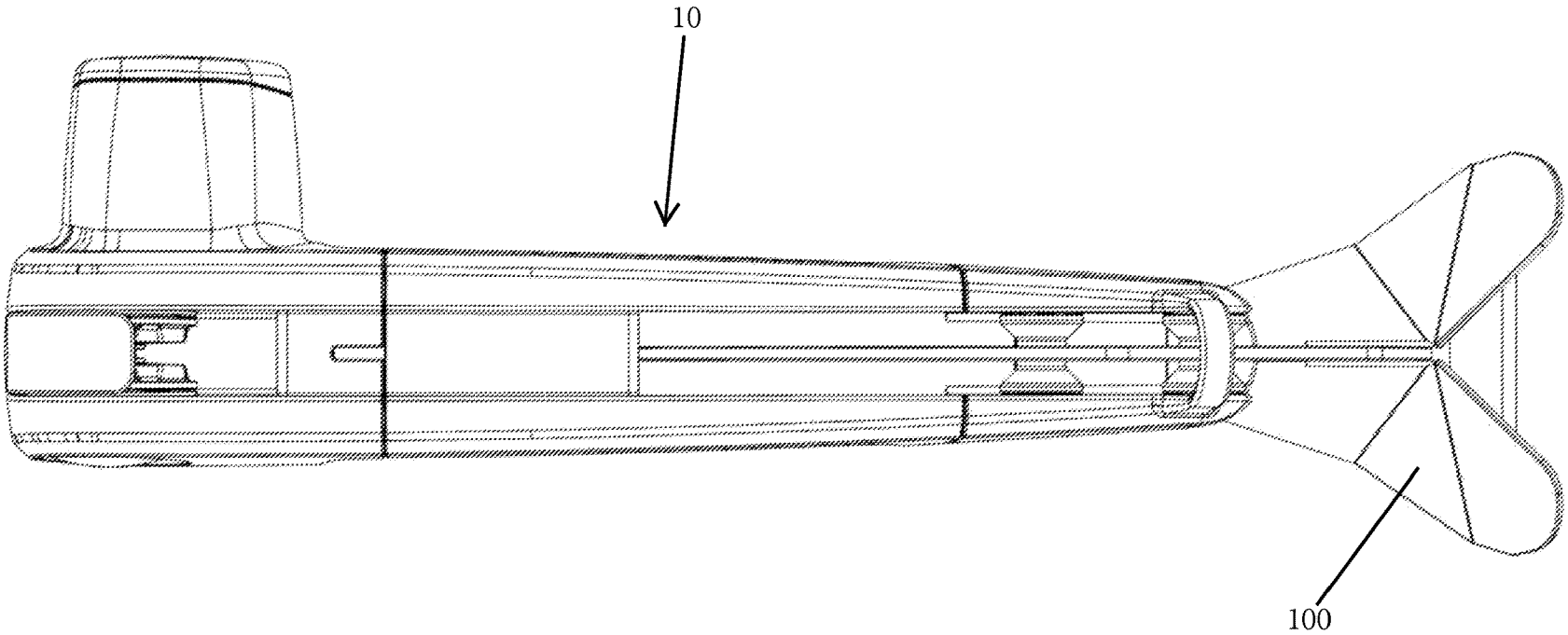

As shown in FIG. 5, the connection portion 14 has a height which varies between the windlass portion 12 and the bow roller portion 16. The height of the connection portion 14 immediately adjacent the windlass portion 12 is substantially the same as the height of the windlass portion where it meets the connection portion. Similarly, the height of the connection portion immediately adjacent the bow roller portion 16 is substantially the same as the height of the bow roller portion where it meets the connection portion. In this way, the connection portion provides a gradual transition between the height difference between the windlass portion and the bow roller portion. In this embodiment, the windlass portion has a greater height than the bow roller portion. In this way, the assembly provides a relatively low-profile arrangement, which is easy for a person to step over with minimal risk of tripping.

To allow some adaptability of the assembly for varying craft designs, the distance between the windlass portion and the bow roller portion is adjustable. This may be achieved, for example, by making available a plurality of connection portions of different lengths as discussed above or by the connection portion including a length adjustment mechanism. The length adjustment mechanism may provide discrete steps of adjustability, or the length may be continuously adjustable, in a manner that will be clearly understood. The cover 40 may cover at least part of the length adjustment mechanism.

The assembly further includes a chain securing mechanism. In the embodiment shown in the drawings, the chain securing mechanism is a chain stopper 46. Chain stopper 46 includes a hinged plate with a slot 48 adapted to fit over a link of the chain. There is also provided a stop (not shown) to limit the travel of the hinged plate. The hinged plate therefore cooperates with the chain to prevent its movement in the forwards direction. The hinged plate is moveable into and out of engagement with the chain via a lever (not shown).

In the embodiment shown, the chain securing mechanism 46 is located at the windlass portion, immediately adjacent the connection portion.

The assembly is installed on a craft using a suitable arrangement of bolts, fitted through corresponding holes in the deck. For relatively small boats (e.g. around 30 feet in length), the present inventors consider that a conventional arrangement of separate windlass and bow roller would require about 12 bolts for securing to the boat. A corresponding assembly according to an embodiment of the invention would require fewer bolts for securing to the boat, typically about 6. The installation time for the assembly is therefore substantially reduced compared with the conventional arrangement of separate windlass and bow roller.

The hauling capacity of the windlass is determined based on the anchor and rode weight, and the anchor shape, which in turn are determined based on the craft dimensions and the user requirements. Similar consideration apply to the bow roller and to the fairlead. For craft lengths in the range 20-60 feet, the length of the assembly (from the back of the windlass portion to the front of the bow roller) is preferably at least 50 cm, more preferably at least 60 cm. This length is preferably at most 200 cm, more preferably at most 150 cm or 100 cm. A length of about 75 cm is considered to be suitable, for example. Where the length is adjustable, preferably it is adjustable by at least 5% of the greatest possible length of the assembly, more preferably by at least 10%. The length may be adjustable by at most 50% of the greatest possible length of the assembly, more preferably at most 25%.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. A windlass assembly for a marine craft anchoring system comprising an anchor and anchor rode, the assembly comprising, before attachment to the craft, a windlass portion and a bow roller portion connected to each other via a connection portion, the windlass portion comprising a gypsy adapted to haul the anchor rode for one turn or less around the gypsy, the connection portion being capable of providing a mechanical link between the windlass portion and the bow roller portion, capable of securing alignment between the windlass portion and the bow roller portion and capable of fixing the spacing between the gypsy and the bow roller portion.

2. A windlass assembly according to claim 1 further including a fairlead portion located at the bow roller portion, for guiding the anchor rode with respect to the bow roller portion.

3. A windlass assembly according to claim 1 wherein there is provided a second roller, aft of the bow roller portion.

4. A windlass assembly according to claim 1 wherein the connection portion defines a channel for the anchor rode to extend between the windlass portion and the bow roller portion.

5. A windlass assembly according to claim 1 wherein there is provided a cover on the connection portion.

6. A windlass assembly according to claim 1 wherein the connection portion has a height which varies between the windlass portion and the bow roller portion.

7. A windlass assembly according to claim 1 further including a rode securing mechanism.

8. A windlass assembly according to claim 7 wherein the rode securing mechanism is a chain stopper.

9. A windlass assembly according to claim 7 wherein the rode securing mechanism is located at the windlass portion.

10. A windlass assembly according to claim 1 wherein the connection portion includes a length adjustment mechanism to allow adjustment of a distance between the windlass portion and the bow roller portion.

11. A method of installing a windlass assembly on a marine craft having a bow, an anchor and an anchor rode, the windlass assembly comprising, before attachment to the craft, a windlass portion and a bow roller portion connected to each other via a connection portion, the windlass portion comprising a gypsy adapted to haul the anchor rode for one turn or less around the gypsy, the method including the step of securing the assembly at the bow of the craft, wherein the connection portion provides at least one of:

(i) a mechanical link between the windlass portion and the bow roller portion;

(ii) alignment between the gypsy and the bow roller portion; and (iii) fixes a spacing between the windlass portion and the bow roller portion, before the assembly is secured to the craft.

12. A method of manufacturing a windlass assembly for a marine craft anchoring system comprising an anchor and anchor rode, the assembly comprising, before attachment to the craft, a windlass portion and a bow roller portion connected to each other via a connection portion, the windlass portion comprising a gypsy adapted to haul the anchor rode for one turn or less around the gypsy, the connection portion being capable of providing a mechanical link between the windlass portion and the bow roller portion, capable of securing alignment between the and the bow roller portion and capable of fixing a spacing between the gypsy and the bow roller portion, the method including, before the assembly is secured to a craft, selecting the connection portion of a desired length from a plurality of connection portions of different lengths, the length being selected to establish a required distance between the windlass portion and bow roller portion, and securing the connection portion between the windlass portion and the bow roller portion.

* * * * *